US007134254B1

(12) United States Patent
Van Gelder

(10) Patent No.: US 7,134,254 B1
(45) Date of Patent: Nov. 14, 2006

(54) SKYLIGHT FALL PROTECTION SAFETY PANEL AND METHOD OF MAKING

(76) Inventor: Terry L. Van Gelder, 15729 Highland Valley Rd., Escondido, CA (US) 92025

( * ) Notice: Subject to any disclaimer, the term of this patent is extended or adjusted under 35 U.S.C. 154(b) by 54 days.

(21) Appl. No.: 10/361,184

(22) Filed: Feb. 10, 2003

(51) Int. Cl.
*E04B 7/18* (2006.01)

(52) U.S. Cl. ..... 52/793.1; 52/799.1; 52/200; 52/673; 52/656.8

(58) Field of Classification Search ..... 52/200, 52/202, 309.16, 506.05, 745.15, 786.11, 786.1, 52/783.11, 783.14, 783.17, 784.14, 793.11, 52/793.1, 673, 799.1, 800.1, 800.11, 656.8; 428/596

See application file for complete search history.

(56) References Cited

U.S. PATENT DOCUMENTS 3,844,087 A * 10/1974 Schultz et al. ..... 52/200
3,940,896 A * 3/1976 Steel ..... 52/307
4,114,330 A * 9/1978 Sukolics ..... 52/200
4,682,454 A * 7/1987 Simpson et al. ..... 52/200
4,703,596 A * 11/1987 Sandow ..... 52/200
4,750,302 A * 6/1988 Bechtold ..... 52/72
4,796,404 A * 1/1989 Butler ..... 52/786.11
4,833,838 A * 5/1989 Van Dame ..... 52/22
RE33,720 E * 10/1991 Cummings ..... 52/200
5,291,705 A * 3/1994 Dickerson ..... 52/200
5,394,664 A * 3/1995 Nowell ..... 52/200
5,509,250 A * 4/1996 Jensen et al. ..... 52/200
5,524,401 A * 6/1996 Ishikawa et al. ..... 52/173.3
5,715,634 A * 2/1998 Schultz ..... 52/200
5,802,783 A * 9/1998 Bayha ..... 52/204.5
5,806,255 A * 9/1998 Verby et al. ..... 52/200
5,862,645 A * 1/1999 Lee ..... 52/786.11
5,983,593 A * 11/1999 Carbary et al. ..... 52/786.11
6,061,993 A * 5/2000 Bendixen et al. ..... 52/783.19
6,138,433 A * 10/2000 Ridge ..... 52/786.11
6,253,530 B1 * 7/2001 Price et al. ..... 52/793.1
6,260,323 B1 * 7/2001 Hockey ..... 52/481.1
6,263,624 B1 * 7/2001 Hoy et al. ..... 52/200
6,308,486 B1 * 10/2001 Medland ..... 52/506.05
6,354,046 B1 * 3/2002 Swearingen ..... 52/97
6,467,118 B1 * 10/2002 Dumlao et al. ..... 14/73
6,604,329 B1 * 8/2003 Hoy et al. ..... 52/200
6,604,332 B1 * 8/2003 Hughes et al. ..... 52/311.3
6,699,558 B1 * 3/2004 Milburn ..... 428/73
6,739,104 B1 * 5/2004 Tokonabe et al. ..... 52/406.2

* cited by examiner

*Primary Examiner*—Peter M. Cuomo
*Assistant Examiner*—Erika Garrett
(74) *Attorney, Agent, or Firm*—Charles C. Logan, II

(57) ABSTRACT

A skylight fall protection safety panel formed from a single sheet of metal having a predetermined surface area A1 and a plurality of apertures are punched out of at least one central perimeter surface area A3. A2 is as great as or greater than 0.60A1. The shape of the apertures can take many different forms but they would have a greatest width D1 that is less than 2.0 inches. The central perforated portion has a sufficient number of apertures of a sufficient size that 50 percent of A2 is open to pass light therethrough. The sheet metal safety panel would be secured under an existing fiberglass skylight panel. The sheet panel can also be corrugated to match translucent skylight panels that are corrugated. The sheet metal panel can also be inserted into a mold or cast with a top layer of resin material and a bottom layer of resin material and also having the central perforated portion apertures filled with resin. This assembled structure functions both as a skylight panel and also as a fall protection safety panel that will prevent workers stepping on the top of the assembled structure from falling therethrough and injuring themselves.

8 Claims, 2 Drawing Sheets

SKYLIGHT FALL PROTECTION SAFETY PANEL AND METHOD OF MAKING

BACKGROUND OF THE INVENTION

The invention relates to safety guard structures for skylights. More specifically, the invention relates to skylight fall protection safety panels that would be installed under the surface of skylights laminated to the underside or cast within the glazing, in the roofs of buildings.

Skylights come in various shapes and sizes including flat, corrugated plastic domed, pyramid or continuous vaulted skylights. The majority of installed skylights are on the relatively flat roofs of schools, warehouses and manufacturing plants. Skylights on relatively flat roofs present a hazard during building construction, roof repair and maintenance on mechanical units that are installed on the roof of the building. Every year, fatal falls result from failure to provide adequate guarding and fall protection around skylights. Persons on the roof may stumble, back on to, sit, or attempt of sit on the skylight, resulting in the person falling through the skylight. Skylights are not designed to support the weight of a person. Thus a safety guard or railing is required to prevent persons from breaking the skylight and falling through the opening.

It is well known in the art that one means for protecting against a person inadvertently falling through a skylight is to install a wire mesh or screen that has been welded together above a flat skylight to prevent a person falling through the skylight. U.S. Pat. Nos. 1,223,530 and 1,236,008 disclose wire mesh positioned a short distance above a flat glass skylight and folded over the skylight frame. Wire mesh is stretched across the skylight and attached to lugs mounted on vertical faces of the skylight frame. The Sandow U.S. Pat. No. 5,419,090 shows another example of a skylight guard assembly. The Sandow U.S. Pat. No. 5,237,788 discloses a skylight guard assembly for a dome shaped skylight.

The Occupational Safety and Health Administration (OSHA) has recognized the dangers posed by skylights and has promulgated requirements for a standard skylight screen. However there has been a reluctance by owners of buildings to retro-fit existing skylights with skylight safety guard assemblies because of the additional cost and also the unsightly appearance of these welded grid structures.

It is an object of the invention to provide a novel skylight fall protection safety panel made from a single sheet of metal having apertures punched out of its central area and that central area would be positioned under a skylight panel, laminated to the underside or cast within the glazing.

It is also an object of the invention to provide a novel skylight fall protection safety panel having a sufficient number of apertures of a sufficient size that over 50 percent of its surface area would transmit light therethrough and also having the size of the apertures small enough that a person can not put their foot though the apertures.

It is another object of the invention to provide a novel skylight fall protection panel that could be made corrugated so that it would mate with the corrugated structure of a skylight panel allowing it to rest directly on the bottom surface of the skylight panel, laminated to the underside or cast within the glazing.

It is an additional object of the invention to provide a novel method of making a skylight fall protection safety panel from a single sheet of perforated or expanded metal.

It is a further object of the invention to provide a novel skylight fall protection safety panel that would prevent workers that step on the top of the skylight structure from falling therethrough and injuring themselves.

SUMMARY OF THE INVENTION

The invention provides a translucent skylight fall protection safety panel for covering skylight openings in industrial buildings, warehouses, and other similar types of buildings. Many of these building are structural steel buildings having little or no slope to their roofs. The support structure for the roofs is normally criss-crossing roofing frame members or beams that provide support for roof panels that are positioned across the open spaces. These panels are primarily steel metal sheets and they may be flat or corrugated. Often there may be more than 100 skylight panel openings in the roof of a building with each covered by either a flat fiberglass translucent panel or a corrugated translucent panel that matches the steel roofing profile. The side edges and ends of these respective translucent panels are secured to the surrounding metal roof panels. Also used in these buildings are domed skylights that are secured to a roof curb.

The strength of the translucent panels is not sufficient to prevent a person who steps thereon from crashing downwardly through the translucent panel and falling 30–40 feet to a concrete floor. Where the sheet metal roof panels are flat, the skylight fall protection safety panel would also be flat. The skylight fall protection safety panel utilizes a single sheet of steel material that is passed through a machine that punches out a large number of apertures in the central perforated or expanded portion of the panel. The dimensions of the central perforated or expanded portion would be approximately the outer dimensions of the framing around the skylight opening itself. Surrounding the central perforated portion are border strip portions that would have a limited number of apertures that would allow the panel to be mechanically fastened to the surrounding sheet metal roofing panels or roof curbs. Even with the large number of apertures in the central perforated or expanded portion, the panel would have sufficient structural strength to withstand a load of at least 400 pounds per square foot at any point on the safety panel. The strength of the panel would also be sufficient to withstand being deflected downwardly a sufficient amount to break the fiberglass panels above them.

The configuration of the apertures could take the form of many different shapes. Two of the most popular would be hexagonal shaped apertures and apertures having four straight side edges. The hexagonal apertures would produce a honeycomb pattern in the central perforated portion. A major consideration for the size of the apertures would relate to allowing a sufficient amount of light to pass through them and then also downwardly through the translucent skylight panels. The other consideration would be that the greatest width of the openings be small enough that a person's foot could not slip downwardly therethrough.

Where the sheet metal roofing panels have a corrugated configuration, the novel skylight fall protection safety panel would be passed through a roller machine to give it a mating corrugated configuration after the apertures were punched out of the central perforated or expanded portion. The surrounding border strip portions would have a limited number of apertures for mechanical fasteners that would be used to secure the skylight fall protection safety panel to the surrounding sheet metal roof panels or roof curbs.

An alternative embodiment of the skylight fall protection safety panel would incorporate additional structure. A layer of resin would be formed on the bottom surface of one of the previously discussed perforated or expanded metal panels and a layer of resin would also be formed on the top surface of the perforated or expanded metal panel. The apertures in the metal panel would also be filled with the same resin. This could be accomplished by placing the metal panel in a mold and pouring the resin therein or some other form of casting. The finished structure produced functions as a skylight panel and also a fall protection safety panel that will prevent workers stepping on the top of the assembled structure from falling therethrough and injuring themselves. This structure would be ideal for use in the initial construction of the roof of the building. This method is applicable to all shapes or types of skylights.

In existing dome shaped skylight panels, it would be possible to remove the dome shaped skylight panel and place one of the flat metal safety panels previously described onto the frame of the skylight aperture and then reinstall the dome skylight panel over the protective metal safety panel. This would not disturb the aesthetic outer appearance of the domed shaped skylight panel while still providing a structure there beneath that would prevent a person from falling through the skylight opening.

DESCRIPTION OF THE PREFERRED EMBODIMENT

Figure 1:
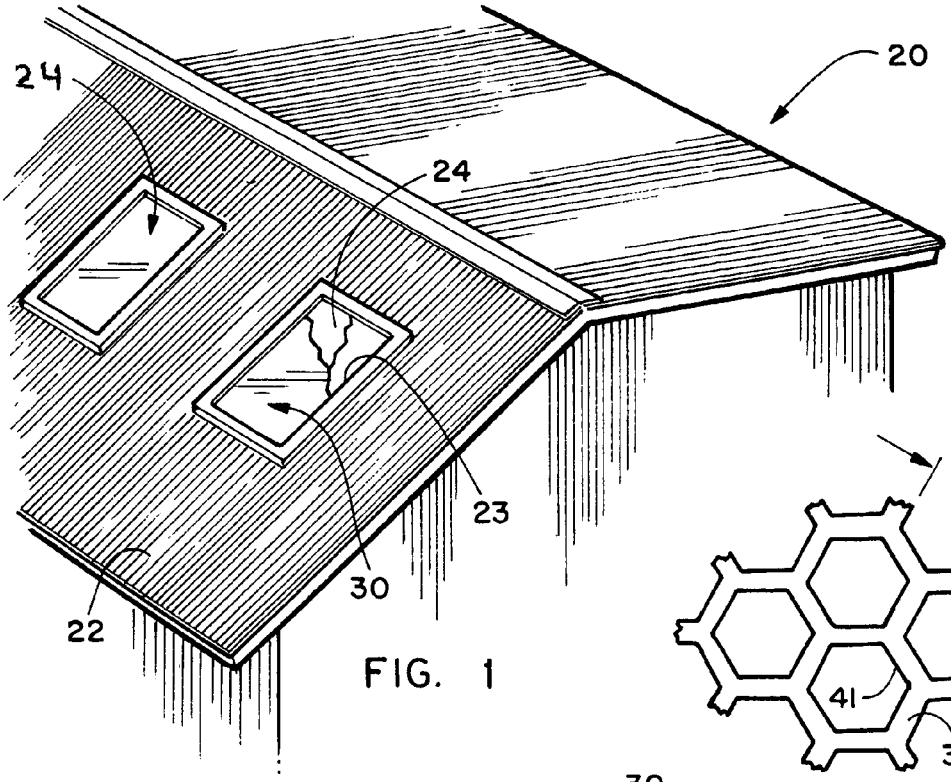
FIG. 1 is a partial perspective view of an industrial building having skylight openings over which the novel skylight fall protection safety panels have been installed.

FIG. 1 schematically illustrates a portion of an industrial building 20 having a sheet metal roof and sheet metal walls. The roof illustrated has corrugated metal panels 22 having spaced skylight openings 23. Corrugated translucent plastic panels 24 are positioned over the skylight openings 23 and secured to the surrounding corrugated panels 22. The sheet metal skylight fall protection safety panel 30 is positioned under the corrugated plastic panels 24 and secured to the surrounding corrugated metal panels 22. The apertures shown in skylight fall protection safety panel 30 have four straight edges and are either square or rectangular.

Figure 7:
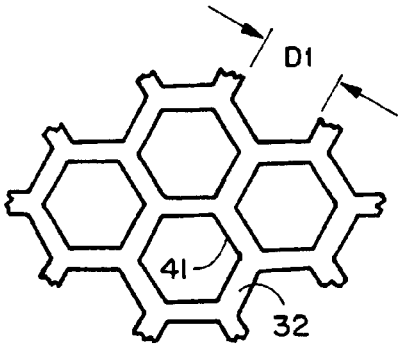
FIG. 7 is a magnified top plan view showing the shape of the apertures in the metal sheet panels illustrated in FIGS. 4 and 6.
Figure 3:
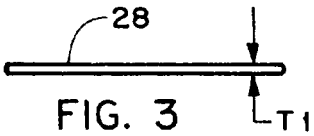
FIG. 3 is a front elevation view of the solid sheet of metal.
Figure 5:
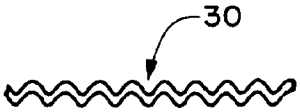
FIG. 5 is a front elevation view of the embodiment in FIG. 4 showing it having a corrugated configuration.
Figure 2:
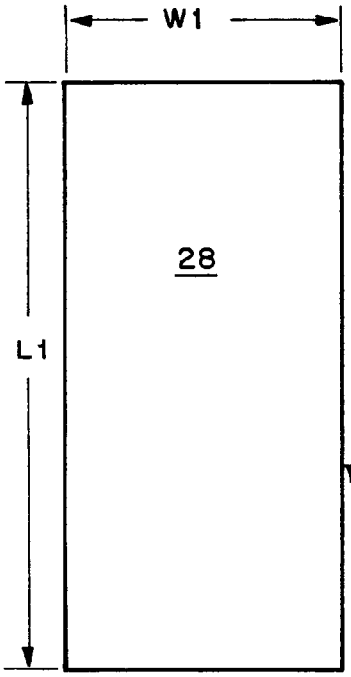
FIG. 2 is a top plan view of the solid sheet of metal showing its initial appearance.
Figure 4:
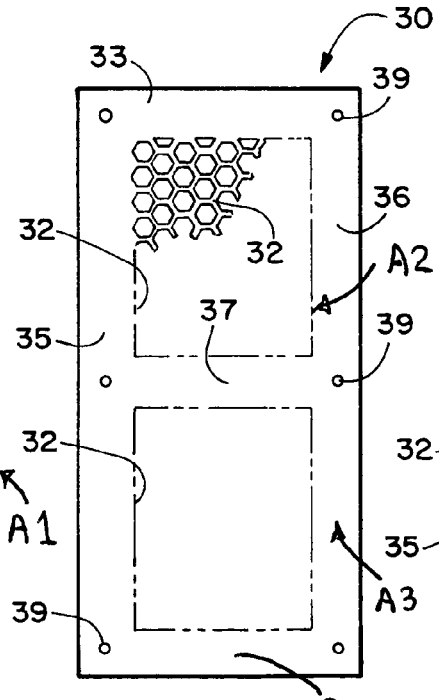
FIG. 4 is a schematic top plan view of the sheet of metal after a plurality of light transmitting apertures have been punched in the sheet; this embodiment has two central perforated portions.
Figure 6:
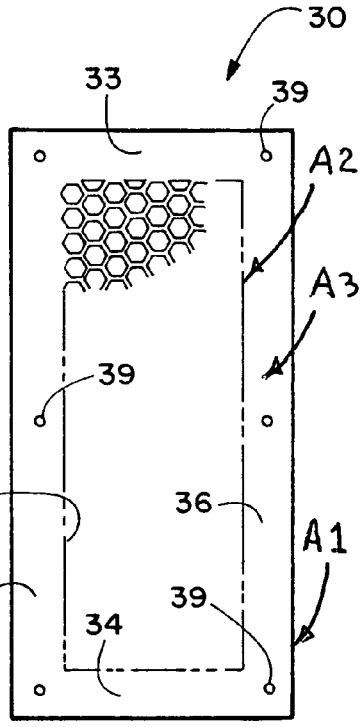
FIG. 6 is a schematic top plan view of a sheet of metal having a single central perforated portion having apertures therein.

Skylight fall protection safety panel 30 initially begins as a solid sheet 28 such as illustrated in FIGS. 2 and 3. It has a length L1 in the range of 5–12 feet, a width W1 in the range of 24–48 inches and a thickness T1 in the range of 18–24 gauge. Steel sheet 28 has a solid top surface area A1 prior to stamping out any of the light transmitting apertures 41. The top surface area A1 is calculated by multiplying L1×W1. Solid sheet 28 would be passed through a machine that stamps out or punch out the light transmitting apertures and this structure is illustrated in FIGS. 4–7. Skylight fall protection safety panel 30 illustrated in FIG. 4 has two central perforated portions 32 that would be installed under an existing translucent skylight panel. The central perforated portions 32 have a surface area A2 that would be calculated by multiplying their length by their width if the central perforated portions have a square or rectangular shape. The surface area A2 of irregularly shaped central perforated portions could be measured by known existing methods. A3 in FIGS. 4 and 6 is the combined sum of the surface areas of border strips 33, 34, 35, and 36 and any transverse strips. Panel 30 has a front transverse border strip 33, a rear transverse border strip 34, a left side border strip 35, a right side border strip 36 and a middle transverse strip 37. FIG. 5 schematically illustrates an end elevation view of panel 30 after it has been passed through rollers to give it a corrugated cross-sectional configuration that would mate with the corrugated cross sectional configuration of a corrugated plastic panel under which it would be installed. The respective border strips have apertures 39 for receiving mechanical fasteners for securing the panels 30 to surrounding metal roof panels. FIG. 7 is a schematic magnified portion of central perforated portion 32 showing the apertures 41 having a hexagonal shape and forming a honeycomb pattern. The apertures have a maximum width dimension D1 that is less than 2.0 inches.

Figure 8:
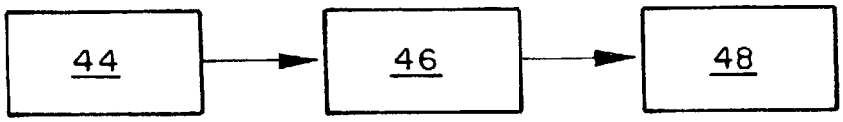
FIG. 8 is a flow diagram showing the method of making the skylight fall protection safety panel.

FIG. 8 illustrates a flow chart showing how the skylight fall protection safety panels are made. 44 indicates that the first step involves taking a flat sheet of metal material. The next step involves placing the flat metal sheet in machine 46 that stamps out the desired aperture pattern. If the skylight fall protection safety panel is going to be used with corrugated metal roof sheets, safety panel 30 is passed through a machine 48 having rollers to produce a corrugated safety panel.

Figure 9:
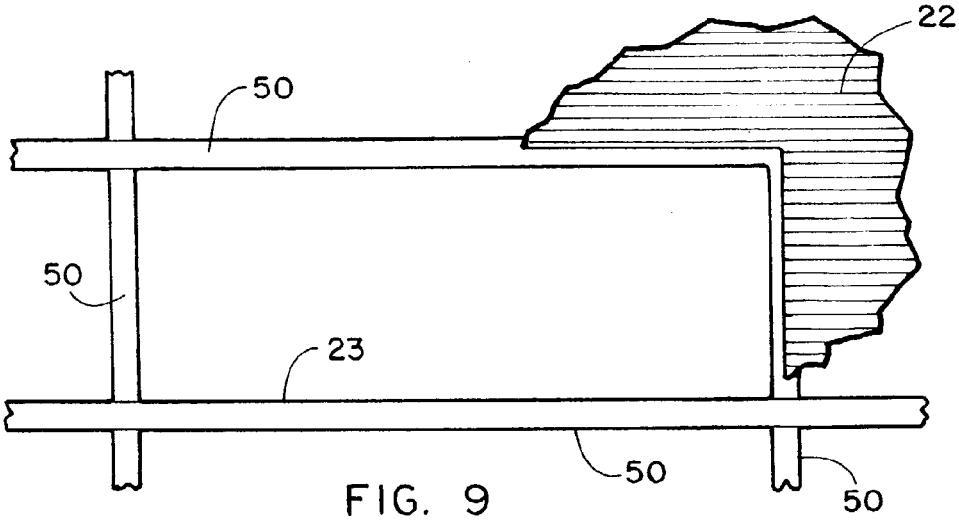
FIG. 9 is a partial top plan view of a skylight opening in the roof of an industrial building.
Figure 10:
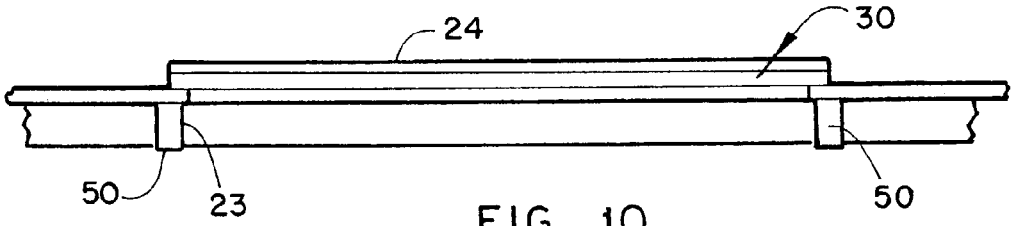
FIG. 10 is a schematic vertical cross-sectional view of the skylight opening in FIG. 9 showing a skylight fall protection safety panel installed under a translucent roof panel.

FIG. 9 is a partial view of the frame for a roof of a building such as shown in FIG. 1. It has criss-crossing roof frame members 50 over top of which are installed flat or corrugated sheet metal panels 22. Skylight opening or aperture 23 would be covered by a skylight fall protection panel 30 and a translucent plastic skylight panel 24. FIG. 10 is a schematic side elevation view of FIG. 9 showing a translucent fiberglass panel 24 positioned over a skylight opening 23 and the skylight fall protection safety panel 30 installed under it.

Figure 11:
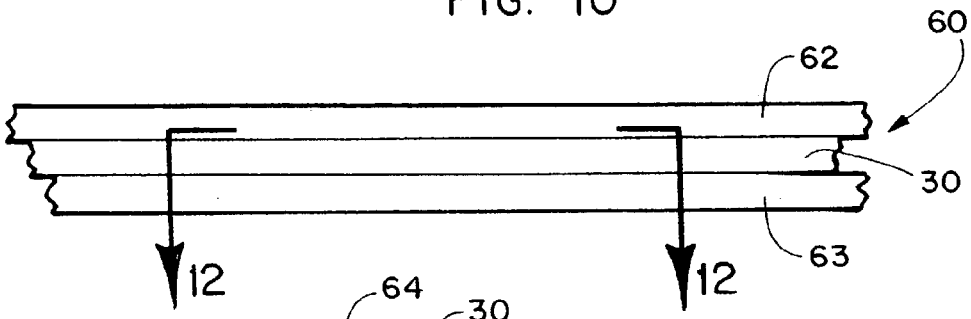
FIG. 11 is a schematic vertical cross sectional view illustrating a first alternative embodiment of the skylight fall protection safety panel.
Figure 12:
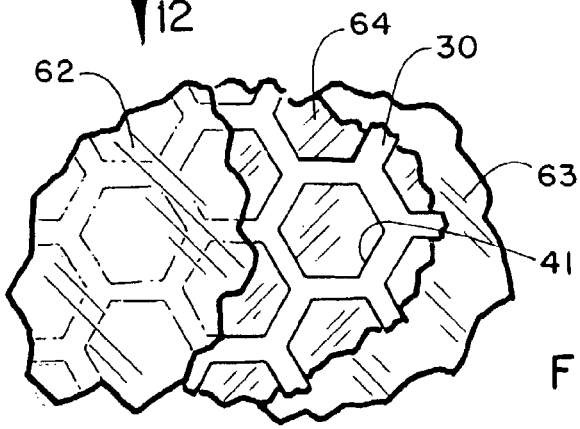
FIG. 12 is a view taken along lines 12—12 of FIG. 11.

FIGS. 11 and 12 illustrates a combination metal safety panel and fiberglass light transmission panel 60. It may have either a flat or a corrugated skylight fall protection safety panel 30 having a fiberglass layer 62 on its top surface and a fiberglass layer 63 on its bottom surface. The apertures 41 in panel 30 would also be filled with the resin layer 64. The resulting product is a unitary structure that functions both as a skylight panel and also as a fall protection safety panel that will prevent workers stepping on the top of the assembled structure from falling through and injuring themselves.

The invention claimed is:

1. A skylight fall protection safety panel comprising:

a sheet of metal having a top surface, a bottom surface, a length L1, a width W1, a thickness T1, a predetermined surface area A1 that is calculated by multiplying L1×W1; at least one central perforated portion having a surface area A2 that is surrounded by border strip portions having a collective perimeter surface area A3 and A2 is as great as or greater than 0.60 A1;

said at least one central perforated portion having a sufficient number of apertures of a sufficient size so that over 50 percent of A2 is open to pass light therethrough, said apertures having a greatest width D1 and D1 is less than 2.0 inches; and means for securing said border strip portions to a roof of an industrial or commercial building so that said at least one central perforated portion is aligned with and oriented over a translucent skylight panel.

2. A skylight fall protection safety panel as recited in claim 1 wherein L1 is in the range of 5–12 feet, W1 is in the range of 24–48 inches and T1 is in the range of 18–24 gauge.

3. A skylight fall protection safety panel as recited in claim 1 wherein said means for securing said border strip portions comprises mechanical fasteners and apertures in said border strip portions for receiving said mechanical fasteners.

4. A skylight fall protection safety panel as recited in claim 1 in combination with a building having a roof having a plurality of translucent skylight panels.

5. A skylight fall protection safety panel as recited in claim 1 wherein said sheet of metal is corrugated across said width W1.

6. A skylight fall protection safety panel as recited in claim 1 wherein said apertures in said central perforated portion have a honeycomb pattern.

7. A skylight fall protection safety panel as recited in claim 1 wherein said sheet of metal has sufficient strength so that it will not rupture under the force of 400 pounds per square foot.

8. A skylight fall protection safety panel as recited in claim 1 further comprising a layer of resin covering said top surface and a layer of resin covering said bottom surface of said sheet metal and said apertures in said central perforated portions are filled with said resin so that said assembled structure functions both as a skylight panel and also as a fall protection safety panel that will prevent workers stepping on the top of said assembled structure from falling therethrough and injuring themselves.

* * * * *